106-74 AU 118 EX
PM004 XR 4,480,681

United States Patent [19]
Alexander et al.

[11] Patent Number: 4,480,681
[45] Date of Patent: Nov. 6, 1984

[54] REFRACTORY MOULD BODY AND METHOD OF CASTING USING THE MOULD BODY

[75] Inventors: Kevin Alexander, Stoke-on-Trent; Howard J. Farr, Stafford, both of England

[73] Assignee: Doulton Industrial Products Limited, Stone, England

[21] Appl. No.: 412,491

[22] Filed: Aug. 30, 1982

[51] Int. Cl.[3] ..... B22C 1/00; B22D 29/00

[52] U.S. Cl. ..... 164/522; 106/38.9; 164/132; 164/138; 501/94

[58] Field of Search ..... 164/522, 132, 138; 106/38.9; 501/94

[56] References Cited

U.S. PATENT DOCUMENTS

| | | | |
|---|---|---|---|
| 3,356,129 | 12/1967 | Anderko et al. | 164/138 |
| 3,548,914 | 12/1970 | Hill et al. | 164/522 |
| 3,701,379 | 10/1972 | Fassler et al. | 164/132 |
| 4,156,614 | 5/1979 | Greskovich et al. | 164/132 X |

FOREIGN PATENT DOCUMENTS

| | | | |
|---|---|---|---|
| 54-60220 | 5/1979 | Japan | 164/522 |

*Primary Examiner*—Nicholas P. Godici
*Assistant Examiner*—J. Reed Batten, Jr.
*Attorney, Agent, or Firm*—Frost & Jacobs

[57] ABSTRACT

A refractory mould core for producing metallic castings of complicated internal shape formed from a water-soluble salt having the following particle size distribution:

100% by weight of the particles have a size less than 750 μm;
90% by weight of the particles have a size of 8–600 μm;
80% by weight of the particles have a size of 5.5–500 μm;
70% by weight of the particles have a size of 4–400 μm;
60% by weight of the particles have a size of 2.8–350 μm;
50% by weight of the particles have a size of 2.0–280 μm;
40% by weight of the particles have a size of 1.6–220 μm;
30% by weight of the particles have a size of 1.0–180 μm;
20% by weight of the particles have a size of 0.3–160 μm;
10% by weight of the particles have a size of 0.1–125 μm.

2 Claims, No Drawings

REFRACTORY MOULD BODY AND METHOD OF CASTING USING THE MOULD BODY

This invention relates to the shaping of mouldable materials, e.g. the production of metal and alloy castings, and is especially concerned with the provision of a novel core or insert for use therein. It is more especially concerned with the provision of a core or insert for use in casting metals and metal alloys, e.g. light metal alloys.

It is well known to employ, for the production of castings, cores or inserts, around which the metal or alloy is cast, made from a ceramic composition which are removed after casting by mechanical means, for example percussion drilling, or in the case of complex core shapes by dissolution in a solvent which does not react with the metal of the casting.

U.K. patent specification No.: 1,005,136 describes the production of a core or insert by moulding a mixture comprising powdered tricalcium silicate or a precursor and a binder into the desired shape, and then firing the formed shape at a temperature in the range 1075° C. to 1125° C. Cores thus formed are especially useful in the casting of metals and alloys such as aluminum and aluminum alloys, from which they may subsequently be removed by dissolution in 50% nitric acid. Cores removable by dissolution in aqueous caustic soda are described in U.K. patent specification No. 1,013,938, according to which they are formed from a mixture comprising from 30–70% of titanium oxide and one or more oxides or precursors of barium, calcium, strontium, magnesium or aluminum. U.K. patent specification No. 1,070,382 describes the manufacture of a core, with or without a mould integral with the core, by firing a shape formed from zirconium oxide or silicate together with one or more oxides or oxide precursors of group IIA metals and/or one or more other refractory oxides or precursors. The cores are said to be useful in the casting of nickel-based alloys, from which they are subsequently removed by treatment with molten or aqueous caustic soda or hydrofluoric acid. In U.K. patent specification No. 1,115,441, there is described a mould/core useful for metal and alloy castings, especially aluminum alloy castings, formed from calcium phosphate and removable from the formed casting by treatment with nitric acid. A core suitable for the casting of group IV Transition metals is described in U.K. patent specification No. 1,299,901, according to which the core is made from alumina, magnesia and/or zirconia and is treated after firing with a carbonaceous material to leave a proportion of finely divided carbon or graphite in the internal and/or external layers.

Cores and moulds made according to these descriptions have been used to a substantial extent. Despite the success of these cores there has grown up in the metal-working industry a demand for a core which, while possessing the advantages of the known cores, is soluble in water so that it may be readily removed from the formed shape, often having a very complicated internal shape, by simply dipping into a bath of water. It is an object of the invention to provide such a water-soluble core.

According to the invention we provide a refractory body consisting essentially of a water-soluble salt having the following particle size distribution:

100% by weight of the particles having a size less than 750 μm;

90% by weight of the particles have a size of 8–600 μm;

80% by weight of the particles have a size of 5.5–500 μm;

70% by weight of the particles have a size of 4–400 μm;

60% by weight of the particles have a size of 2.8–350 μm;

50% by weight of the particles have a size of 2.0–280 μm;

40% by weight of the particles have a size of 1.6–220 μm;

30% by weight of the particles have a size of 1.0–180 μm;

20% by weight of the particles have a size of 0.3–160 μm;

10% by weight of the particles have a size of 0.1–125 μm.

In a preferred aspect of the invention the water-soluble salt has a particle size distribution as follows:

between 8 and 11% by weight of the particles have a particle size less than 3 μm;

between 9 and 14% by weight of the particles have a particle size less than 4 μm;

between 12 and 19% by weight of the particles have a particle size less than 6 μm;

between 15 and 23% by weight of the particles have a particle size less than 8 μm;

between 19 and 29% by weight of the particles have a particle size less than 11 μm;

between 25 and 36% by weight of the particles have a particle size less than 16 μm;

between 31 and 42% by weight of the particles have a particle size less than 22 μm;

between 38 and 50% by weight of the particles have a particle size less than 31 μm;

between 44 and 58% by weight of the particles have a particle size less than 44 μm;

between 54 and 68% by weight of the particles have a particle size less than 62 μm;

between 65 and 77% by weight of the particles have a particle size less than 88 μm;

between 75 and 85% by weight of the particles have a particle size less than 125 μm;

100% by weight of the particles have a particle size less than 175 μm;

The invention also provides a method of producing a casting of a castable metal or alloy, comprising forming a mould including a mould and/or core(s) constituted by a composition which comprises essentially a water-soluble salt the particle size distribution of which is as specified hereinbefore, introducing into the mould assembly a charge of the castable metal or alloy in molten form, allowing the charge to solidify, and removing the mould and/or core(s) from the casting so formed.

Suitable water-soluble salts for use in manufacturing the cores/moulds of the present invention include sodium and potassium chlorides and sodium metasilicate. Sodium chloride is the preferred salt, and of course has the advantage of being readily available in economically attractive quantities. Of course, the precise water-soluble salt used in any particlar case will be chosen having regard to the fact that it must not melt or decompose at the temperature of use, i.e. approximately the melting point of the metal or other material being cast or moulded around it. For example, sodium chloride, having a melting point of 800° C., is eminently suitable for use in casting aluminium, melting point 660° C. So also are potassium chloride and sodium metasilicate (melting points 776° C. and 1088° C. respectively).

The cores of the invention are suitably manufactured by forming a mixture comprising the water-soluble salt and a temporary binder, shaping the mixture into the desired form, and firing the form inter alia to remove the binder. The mixture may contain other materials as required, for example to enhance certain desirable properties of the core, and such additional ingredients may include for example one or more of silica, alumina, zircon, aluminosilicates, talc magnesia, mullite, ground porcelain and sillimanite. The additional ingredients preferably melt at temperatures above 800° C., most preferably above 1000° C., and may be present in the core-forming mixture in amounts up to 10% by weight of the total mixture, most suitably in amounts of 2.0 to 2.5%, on the same basis.

The temporary binder, used to bind the ingredients of the core-forming mixture together during shaping thereof, and which is burnt off during firing, may be any of the known binders described in the prior specifications discussed above. Thus, the binder may be a paraffin wax, a synthetic organic resin such as a polystyrene or a silicone resin. We prefer however to use a polyethylene glycol, suitably one having a molecular weight in the range 4000–8000, and most preferably one of molecular weight 6000. The binder is preferably present in just such an amount as will fill the voids in a randomly packed powder and will allow shaping.

It is necessary that the water-soluble salt should be wetted by the binder. In some cases, the presence of a wetting agent may be required in order to ensure this. When the water-soluble salt has a negative charge on its surface, e.g. in the case of sodium or potassium chloride, the presence of an anionic surfactant is desirable. Suitable surfactants are those of the ether sulphate type, amongst which we prefer to use that sold under the trade name "Solumin PFN 20" by ABM Chemicals Limited. Surfactants are suitably present in the core-forming mixture in an amount of 0.2–2.0% by weight, based on the weight of the mixture.

The core or inserts of the invention are made by firstly preparing a mixture of the moulding composition ingredients, i.e. the water-soluble salt, the binder, the surfactant and any other desired materials, and thoroughly mixing the ingredients. The resulting paste is granulated and then shaped into the desired core shape. Shaping may be carried out by isostatic pressing, injection moulding, compression moulding, transfer moulding, extrusion or casting. Injection moulding is a preferred procedure, and will be followed by firing of the shaped core to drive off the organic materials and sinter the particles of the water-soluble salt. Sintering has the effect of slightly fusing adjacent particles of the salt, giving a porous structure to the formed core. It is of course desirable that the degree of shrinkage of the core which occurs during sintering should be held to a minimum, and the presence in the core-forming mixture of inert materials helps to prevent this.

It is an important feature of the present invention that the particles of water-soluble salt used as the major ingredient of the core-forming mixture should have a particular and special particle size distribution. A further feature of the invention is means for achieving this particle size distribution. According to the invention this is achieved by means of a non-standard wet milling technique. When sodium chloride, potassium chloride or sodium metasilicate are milled using a standard ball milling technique, the particles of the material are reduced to smaller particles each having the same particle diameter or a spread of particle diameters within a very narrow range. In accordance with the present invention the milling is conducted so as to give the particle size distribution recited above. One way of achieving this is to mill the salt particles to give batches having the particle sizes within the above-quoted ranges, and then to effect an admixture of the milled particles to produce a particle mixture having the distribution of particle size specified. According to a feature of the invention, however, the milling of the salt particles is conducted in a single stage operation, by wet-grinding the salt particles in a suitable grinding liquid. The grinding liquid should be non-aqueous, non-polar and inert to the salt particles, and examples include ethanol and liquid paraffins. The method of ballmilling involves the following parameters:

(1) the charging of the mill with substantially equal volumes of water-soluble salt and grinding medium (e.g. balls);

(ii) the use of substantially 2 kilogrammes of water-soluble salt to 1 cubic decimeter of grinding liquid;

(iii) the use of substantially 1 kilogramme of water-soluble salt to 5 cubic decimeters of mill capacity.

Milling proceeds until the requisite particle size distribution is achieved. Typical milling conditions involve a rate of revolution of the ball mill of 68 r.p.m., a mill diameter of 56 cms., and a milling time of 0.5 to 1 hr.

The following example is given for the purpose of illustrating the invention.

EXAMPLE

Sodium chloride crystals, having a particle mono size in the range 150–200 μm were wet ground in ethanol. The grinding conditions were:

(i) equal volumes of sodium chloride and grinding balls;

(ii) 2 kg of sodium chloride to 1 cubic decimeter of ethanol;

(iii) 1 kg of sodium chloride to 5 cubic decimeters of mill capacity.

After milling the sodium chloride particles were treated with an anionic surface active agent in order to render them wettable by the binder. Specifically, the sodium chloride particles were heated to 70° C. and 1% by weight of Solumin PFN 20 (A.B.M. Chemicals Limited) was added. The mixture was then thoroughly mixed for 30 minutes in a twin Z-blade mixer.

A core-forming mixture may be prepared from the following ingredients:

Sodium chloride 70–85% by weight;
Surfactant 0.5–1.5% by weight;
Polyethylene glycol (mw 6000) 12–19% by weight;
Diethyleneglycolmonostearate 4.8–7.6% by weight;
Di-isooctylphthalate 1.6–2.7% by weight.

A particularly suitable moulding composition comprises the following ingredients:

Sodium chloride 70.75% by weight;
Surfactant 1.00% by weight;
Polyethylene glycol (mw 6000) 18.35% by weight;
Diethyleneglycolmonostearate 7.35% by weight;
Di-isooctylphthalate 2.55% by weight.

In making up the above mixture the remaining ingredients are added to the surfactant-treated sodium chloride and mixing occurs for approximately 60 minutes. The paste thus formed is removed from the mixer and granulated into a size suitable for injection moulding.

Cores are moulded from these granules by injection moulding in the conventional manner, the moulding composition being at a temperature of approximately 70° C. and the temperature of the mould being approximately 25° C.

After removing the shaped core from the injection mould, it is placed in a refractory powder (e.g. alumina dust) in a refractory box (e.g. a saggar), and heated to 700° C. The rate of temperature rise is preferably not more than 20° C. per hour up to 200° C., and no more than 40° C. per hour up to 700° C. The shaped core is fired at 700° C. for at least 4 hours.

The formed core thereafter finds use in the casting of metals and metal alloys, from which it may subsequently be removed by dissolution in water. The casting techniques in which it may be used include gravity die-casting, pressure die-casting, sand casting, investment casting and other refractory mould casting techniques. The cores are of particular utility in the casting of aluminum and aluminum alloys, in magnesium casting and in zinc-based die-casting.

Although the invention has been described with particular reference to the casting of metals and metal alloys, it should be remarked that the cores of the invention are also useful in the moulding of plastics materials, for example using injection and transfer moulding techniques.

We claim:

1. A refractory body consisting essentially of a water-soluble salt having the following particle size distribution:

100% by weight of the particles have a size less than 750 μm;

90% by weight of the particles have a size of 8–600 μm;

80% by weight of the particles have a size of 5.5–500 μm;

70% by weight of the particles have a size of 4–400 μm;

60% by weight of the particles have a size of 2.8–350 μm;

50% by weight of the particles have a size of 2.0–280 μm;

40% by weight of the particles have a size of 1.6–220 μm;

30% by weight of the particles have a size of 1.0–180 μm;

20% by weight of the particles have a size of 0.3–160 μm;

10% by weight of the particles have a size of 0.1–125 μm.

2. A method of producing a casting of a castable metal or alloy, comprising forming a mold assembly including a foundry mold part constituted by a composition which consists essentially of a water-soluble salt having the following particle size distribution:

100% by weight of the particles have a size less than 750 μm;

90% by weight of the particles have a size of 8–600 μm;

80% by weight of the particles have a size of 5.5–500 μm;

70% by weight of the particles have a size of 4–400 μm;

60% by weight of the particles have a size of 2.8–350 μm;

50% by weight of the particles have a size of 2.0–280 μm;

40% by weight of the particles have a size of 1.6–220 μm;

30% by weight of the particles have a size of 1.0–180 μm;

20% by weight of the particles have a size of 0.3–160 μm;

10% by weight of the particles have a size of 0.1–125 μm;

introducing into the mold assembly a charge of the castable metal or alloy in molten form, allowing the charge to solidify, and removing the foundry mold part from the casting so formed.

* * * * *